United States Patent [19]

Larrecq et al.

[11] Patent Number: 4,671,340

[45] Date of Patent: Jun. 9, 1987

[54] ROLLER FOR CONTINUOUS CASTING BETWEEN ROLLERS, WITH CIRCULATION OF COOLING FLUID

[75] Inventors: Michel Larrecq; Louis Vedda, both of Metz, France

[73] Assignee: Institut de Recherches de la Siderurgie Francaise, Maizieres-les-Metz, France

[21] Appl. No.: 906,827

[22] Filed: Sep. 12, 1986

[30] Foreign Application Priority Data

Sep. 17, 1985 [FR] France ..... 85 13776

[51] Int. Cl.[4] ..... B22D 11/06; B22D 11/124

[52] U.S. Cl. ..... 164/429; 164/443

[58] Field of Search ..... 164/485, 443, 428, 348, 164/479, 429, 442, 448; 165/89

[56] References Cited

U.S. PATENT DOCUMENTS

| | | | |
|---|---|---|---|
| 1,651,502 | 12/1927 | Banbury | 165/89 |
| 1,892,028 | 12/1932 | Alderfer | 165/89 |
| 2,671,278 | 3/1954 | Hinnekens | 165/89 |
| 2,793,006 | 5/1957 | Eaby | 165/89 |
| 3,419,068 | 12/1968 | Grierson | 165/89 |
| 4,307,771 | 12/1981 | Draizen et al. | 164/485 |
| 4,489,772 | 12/1984 | McLane et al. | 164/485 |
| 4,502,528 | 3/1985 | Frissora et al. | 164/485 |
| 4,537,289 | 8/1985 | Budzyn et al. | 164/443 |

*Primary Examiner*—Nicholas P. Godici
*Assistant Examiner*—Samuel M. Heinrich
*Attorney, Agent, or Firm*—Staas & Halsey

[57] ABSTRACT

This invention relates to a roller for continuous casting between rollers, with circulation of cooling fluid. In this roller, comprising a cylindrical body surrounded by an envelope, the cooling fluid circulation channels disposed circumferentially between the body and the envelope, are constituted by groups of grooves on the inner surface of the envelope extending over arcs of circumference, and organizing the circulation in distinct angular sectors corresponding to each group. Axial throats are provided between the body and the envelope at the ends of each sector, and into which open out, on the one hand, radial fluid admission and return pipes passing through the body, and, on the other hand, the grooves of a group by one of their ends, the throats being in a number double that of the angular sectors.

10 Claims, 2 Drawing Figures

ROLLER FOR CONTINUOUS CASTING BETWEEN ROLLERS, WITH CIRCULATION OF COOLING FLUID

The present invention relates to the cooling of the rollers for continuous casting between rollers.

Continuous casting between rollers of metals, such as steel or aluminium, is known, and may be carried out in various manners depending on whether casting is vertical or horizontal.

Cooled rollers are known, for example as disclosed by French Patent No. 1 567 196, which shows a jacket surrounding the roller and traversed by numerous embedded axial pipes; by U.S. Pat. No. 3,038,219 which shows axial channels for circulation, made on the roller body underneath the copper envelope which surrounds it; by French Patent No. 1 198 006 which shows circumferential channels housed in the roller body and covered by a copper hoop.

For various reasons, an axial circulation of the cooling water is not satisfactory (for example, for homogeneity in the transverse direction of the metal product cast), and the teachings of the first two documents cited above are, in addition, very schematic and incomplete.

The teaching of the third document is hardly more satisfactory, as the solution presented necessitates a complicated and expensive machining of the roller body. Furthermore, heat exchanges are not optimalized and, in addition, there is observed, under the pressure of the water in the circumferential channels, a tendency of the hoop to swell and to be deformed, which can be obviated only by an expensive increase of the thickness of copper of the hoop.

It is an object of the invention to propose a cooled roller not presenting the drawbacks set forth hereinabove, which is of relatively simple construction, allows a more efficient cooling and is not subject to deformations detrimental to the quality of the product cast.

To attain this object, the invention proposes a roller comprising a cylindrical body surrounded by an envelope; parallel channels for circulation of cooling fluid disposed circumferentially between the body and the envelope; inlet and outlet manifolds for the fluid and admission and return pipes for the fluid passing through the body and connecting the manifolds to the circulation channels. This roller is characterized in that the channels are constituted by groups of grooves made on the inner surface of the envelope, extending over arcs of circumferences organizing the circulation in distinct and separate sectors, hydraulically mounted in parallel, in that axial throats are provided between the body and the envelope at the two ends of each sector and into which open out, on the one hand, in their bottom, the cooling water admission and return pipes, and, on the other hand, laterally, the grooves of a group by one of their ends, and in that the cooling fluid inlet and outlet manifolds are coaxial with respect to each other and with the cylindrical body.

It is easy to machine the circulation channels in the envelope (made of copper or copper alloy). Such a location of the channels further offers three surfaces for heat exchange with the cooling water. The width and spaced apart relationship of the channels are easily calculated in order not to provoke collapse or swelling of the envelope. Such deformations are even less to be feared as the organization of the circumferential circulation in distinct sectors avoids reaching undesirable pressures (higher than 7 bars) which would cause detachment of the copper.

A distribution into three angular sectors, each of 120°, is particularly advantageous. A larger number increases the number of bends and therefore raises the pressure drops, which makes it necessary to increase the inlet pressure. A smaller number increases the length of the circuits in the circulation channels and therefore also the pressure drops. The fact that the sectors are distinct, therefore independent of one another, allows a uniform circulation of cooling fluid over the whole periphery of the roller, for example in the direction opposite that of its rotation. In this way, a counter-flow circulation will be established with the product cast, which is known to be more efficient, from the standpoint of heat exchange, than a circulation in the same direction.

The preferred speed of water circulation is of the order of 6 m/s.

A higher speed is not desirable as it provokes a substantial increase in the pressure drops.

A lower speed leads, instead of a transfer of heat by forced convection without formation of vapour:

either to a transfer in nucleate boiling, i.e. the formation of fine vapour bubbles on the surface, which recondense in the surrounding liquid. The accumulation of these bubbles constitutes a veritable "vapour plug" in the circuit and blocks the passage of water. It is known, that, in conventional continuous casting moulds, the direction of passage of the cooling water is ascending, from bottom to top, so that the vapour rises naturally with the water, without opposition. The circulation of the cooling water in the separate sectors of the rollers according to the invention is organized to reproduce this same condition;

or a transfer in free boiling, i.e. the formation of a more or less stable film of vapour on the surface to be cooled. This film, constituting a veritable heat resistance, opposes the extraction of the heat, the temperature rises and the copper may then "burn" on the surface in contact with the steel.

Moreover, a rapid circulation limits the deposits of limestone or various salts, which are inevitable despite the use of water which has been treated.

The cooling roller is supplied with water through a double flow rotating joint, especially designed to respond to the particular specifications required, taking into account the vicinity of the molten metal: flowrate (about 40 $m^3/h$) under low pressure and, in order to limit the pressure drops, at the lowest possible speed (apart from the restriction of the circulation channels where the speed is about 6 m/s); low speed of rotation of the roller (about 30 revs/min.).

The invention will be more readily understood on reading the following description with reference to the accompanying drawings, in which.

Figure 1:
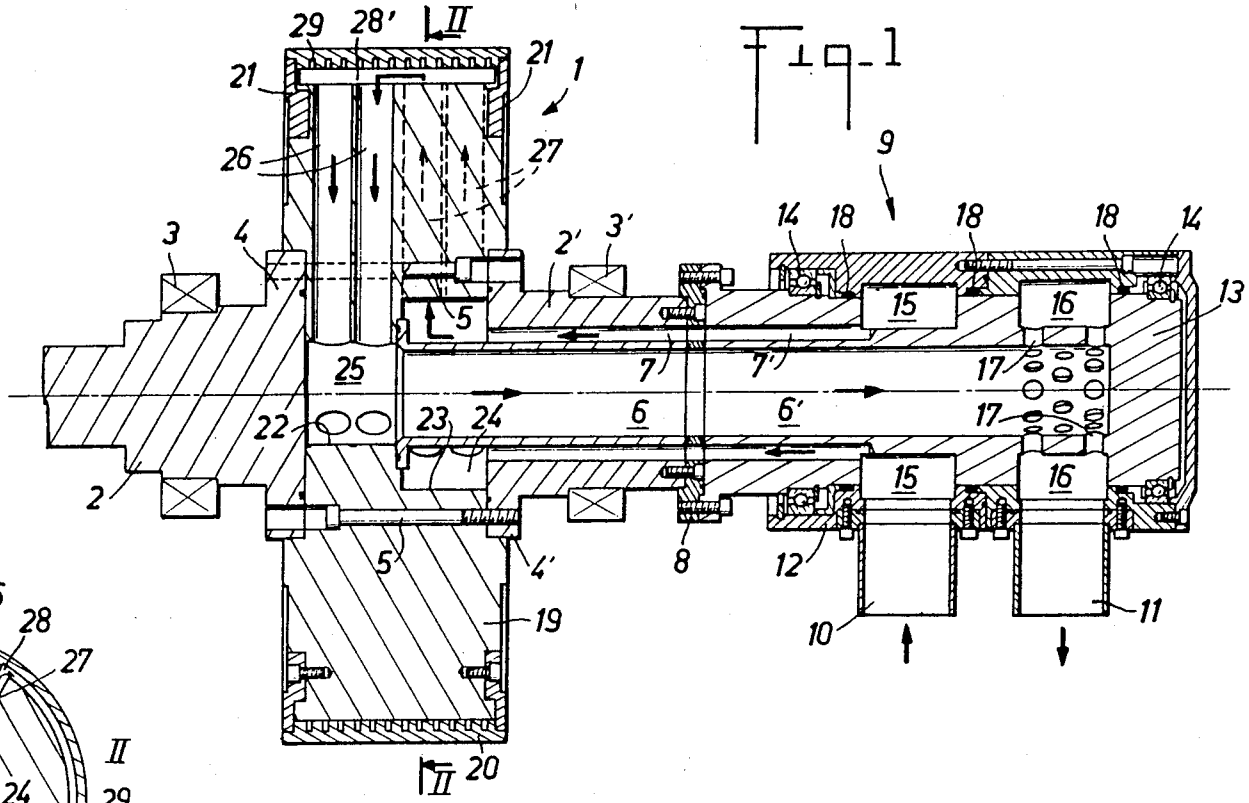
FIG. 1 is a view in axial section of a roller and its device for supplying cooling water.

Referring now to the drawings, each roller of the invention is composed of a cooling drum 1 to which are fixed journals 2, 2' rotating in swivel bearings 3, 3', mounted on a chassis (not shown).

The journals 2, 2' are fixed by means of flanges 4, 4' surrounding the drum 1 and maintained together by fixing elements, or ties, (bolts 5) passing through the drum 1.

Journal 2 is coupled in conventional manner (e.g. a Universal joint) to means for driving in rotation (not shown).

Journal 2', connected by an intermediate fixing flange 8 to a cooling water supply device 9, is hollow in order to allow passage of the inlet and outlet manifolds 6, 7, respectively, coaxial to drum 1.

The supply device 9 comprises a fixed conduit 10 for admission of water and a fixed conduit 11 for outlet of water, tapped radially on a fixed casing 12. A cylindrical bush 13, fixed to flange 8, is fast in rotation with journal 2', and rotates in casing 12 thanks to ball bearings 14.

The bush 13 comprises a blind central bore 6' extending the manifold 6 and an annular chamber 7' surrounding the bore 6', extending the annular manifold 7.

Opposite peripheral grooves, formed in the bush 13 and casing 12, constitute two annular chambers 15 and 16 of the supply device, communicating respectively with conduits 10 and 11.

Radial channels 17 communicate bore 6' with chamber 16 and therefore with outlet 11.

Annular chamber 7' opens out directly into chamber 15 and may therefore communicate with inlet 10.

Adequate seals 18 complete this rotating joint.

Drum 1 is composed of a cylindrical support body 19 made of steel, placed in a copper envelope 20. Two cheek-rings 21, laterally overlapping body 19 and envelope 20, are fixed on body 19 and thus immobilize envelope 20.

Body 19 comprises a central bore formed by two parts 22, 23, of different diameter. Part 22, of smaller diameter, comes into line with the outlet manifold 6 which advances to inside the drum and abuts against a shoulder formed between the two parts 22, 23. Part 23, of larger diameter, surrounds the advanced end of the outlet manifold 6 and forms therewith and with the said shoulder an annular chamber 24, into which the inlet manifold 7 opens out. Part 22 and journal 2 define a central chamber 25.

Pairs of radial admission and return pipes 27, 26, respectively, radiate from the inlet (24) and outlet chambers, respectively, and open out at the bottom of throats 28 and 28', machined on the periphery of body 19, parallel to its axis.

Parallel grooves 29, preferably of rectangular section for reasons of simplicity, and extending in arcs of circle, are machined on the inner surface of the copper envelope 20 and constitute channels which connect an axial throat 28 via which the water enters, to the following axial throat 28' via which the water leaves.

Figure 2:
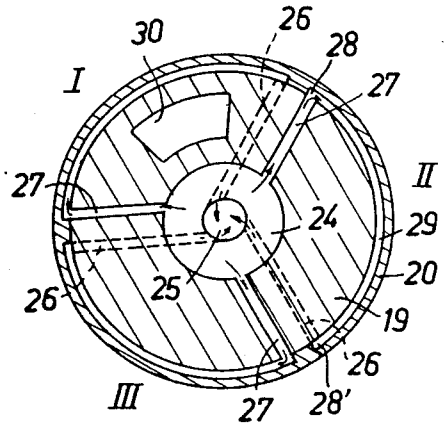
FIG. 2 is a schematic transverse section along II—II of the roller of FIG. 1.

As is clearly shown in FIG. 2, the water circulation is organized in three independent sectors I, II, III, each of 120°, hydraulically mounted in parallel, and each comprising, in the direction of circulation of the water, a radial inlet pipe 27, issuing from the inlet manifold 7 and opening out into the bottom of a first axial throat 28, said throat 28 distributing the cooling water in the parallel grooves 29, said grooves 29 which open out laterally into a second axial throat 28', at an angular distance of about 120° from the first, said groove 28' which collects the water towards the radial return pipe 26, and said return pipe 6 which supplies the outlet manifold 6.

The cooling water follows a path indicated by the arrows, from inlet 10 up to outlet 11. It is particularly clear from FIG. 2 that the water circulates in all the sectors in the same direction, trigonometric or anti-trigonometric, determined so that, in the sectors in contact with the metal cast (sectors I, II to the left in FIG. 2), the circulation is ascending, i.e. opposite the direction of displacement of the product cast.

The solid body 19 is lightened by cavities 30 (only one has been shown in FIG. 2, but there may be several in each sector), which are advantageously put to use by implanting therein measuring apparatus (thermocouples, . . . ) and/or data recording systems (particularly of measurement) such as readwrite memories, or receivers, etc. . . . intended better to follow the process of continuous casting between rollers.

In order further to reduce inertia, the cylindrical body 19 may be constituted by a simple ferrule applied against the inner periphery of the envelope 20. In that case, it is the pipes conducting the water to the grooves and the return pipes which, composed of visible conduits, ensure mechanical rigidity of the assembly, in the manner of the spokes of a wheel of which the rim is formed by the ferrule and envelope joined.

Furthermore, as will have been understood, the axial throats 28 and 28' have been provided in particular to enable the radial pipes 26 and 27 to be limited to two per sector.

Similarly, the water inlet and outlet by single manifolds such as 6 and 7, coaxial to each other and to the cylindrical body 19, make it possible, if necessary, to modify the number of sectors on a given roller, without too much difficulty, by means of conventional machining and assembly operations.

What is claimed is:

1. In a roller for an installation for continuous casting between rollers, of the type comprising:

a cylindrical body surrounded by an envelope;

parallel channels for circulation of cooling fluid, disposed circumferentially between the body and the envelope;

inlet and outlet manifolds for the fluid, and admission and return pipes for the fluid passing through the body and connecting the manifolds to the channels, said circumferential channels are constituted by groups of grooves on the inner surface of the envelope, extending over arcs of circumferences, and organizing the circulation in distinct sectors corresponding to each group;

said manifolds are coaxial to the cylindrical body, and axial throats are provided between the body and the envelope at the ends of each sector and into which open out, on the one hand, the admission and return pipes passing through said body, and, on the other hand, the grooves of a group, by one of their ends.

2. The roller of claim 1, wherein three sectors for circulation are provided, each of 120°.

3. The roller of claim 1, wherein the body is made of steel and the envelope is made of copper or copper alloy.

4. The roller of claim 1, wherein the envelope is maintained on the body by lateral cheek-rings.

5. The roller of claim 1, wherein journals are provided, fixed laterally on the body by fixing elements.

6. The roller of claim 1, wherein it is associated with a device with a rotating joint for supplying cooling fluid.

7. The roller of claim 1, wherein the body comprises cavities for housing measuring and recording apparatus.

8. The roller of claim 1, wherein said axial throats are machined on the periphery of the body.

9. The roller of claim 1, wherein the cylindrical body is a solid body pierced radially to form the cooling fluid admission and return pipes therein.

10. The roller of claim 1, wherein the cooling fluid admission and return pipes are visible conduits, the cylindrical body being constituted by a single ferrule applied internally against the envelope.

* * * * *